US011753936B2

(12) United States Patent
Wang et al.

(10) Patent No.: US 11,753,936 B2
(45) Date of Patent: Sep. 12, 2023

(54) COMPOSITE SUPPORT SYSTEM BASED ON STEEL-CONCRETE SUPPORT AND SHOTCRETE ARCH AND CONSTRUCTION PROCESS THEREOF

(71) Applicant: Shandong Jianzu University, Jinan (CN)

(72) Inventors: Jun Wang, Jinan (CN); Chuan-gen Zhu, Jinan (CN); Jian-ping Zuo, Beijing (CN); Bo Wang, Langfang (CN); Wan-peng Huang, Qingdao (CN); Hou-gang Ding, Jinan (CN)

(73) Assignee: Shandong Jianzu University, Jinan (CN)

( * ) Notice: Subject to any disclaimer, the term of this patent is extended or adjusted under 35 U.S.C. 154(b) by 0 days.

(21) Appl. No.: 18/109,268

(22) Filed: Feb. 14, 2023

(65) Prior Publication Data

US 2023/0258085 A1 Aug. 17, 2023

(30) Foreign Application Priority Data

Feb. 14, 2022 (CN) ..... 202210131536.1

(51) Int. Cl.
*E21D 11/15* (2006.01)
*E21D 11/10* (2006.01)
*E21D 11/18* (2006.01)

(52) U.S. Cl.
CPC ..... *E21D 11/10* (2013.01); *E21D 11/107* (2013.01); *E21D 11/152* (2013.01); *E21D 11/18* (2013.01)

(58) Field of Classification Search
CPC ..... E21D 11/10; E21D 11/107; E21D 11/152; E21D 11/18
See application file for complete search history.

(56) References Cited

U.S. PATENT DOCUMENTS 2,096,850 A * 10/1937 Forsberg ..... E21D 11/15 249/11
3,545,213 A * 12/1970 Hofbauer ..... E21D 11/10 52/249

(Continued)

FOREIGN PATENT DOCUMENTS

CN 101493011 A 7/2009
CN 101725362 A 6/2010

*Primary Examiner* — Benjamin F Fiorello
(74) *Attorney, Agent, or Firm* — Bayramoglu Law Offices LLC

(57) ABSTRACT

A composite support system based on a steel-concrete (concrete-filled steel tube) support and a shotcrete arch includes an anchor mesh layer provided on an inner wall of a roadway. A flexible compressible layer is provided on the outer side of the anchor mesh layer; a support frame is erected on the outer side of the flexible compressible layer; reinforcement meshes are respectively arranged on an inner side and an outer side of the support frame; the support frame and the reinforcement meshes form a framework to construct an arch spray layer; the reinforcement meshes and the support frame are embedded into an arch structure to form a rigid layer; the flexible compressible layer is provided between the rigid layer and the anchor spray layer. When the flexible compressible layer is compressed, the flexible compressible layer is deformed toward a reserved deformation space for a yielding purpose.

13 Claims, 5 Drawing Sheets

(56) References Cited

U.S. PATENT DOCUMENTS

| | | | | | |
|---|---|---|---|---|---|
| 4,390,306 | A * | 6/1983 | Fisher | E21D 11/18 | 405/150.1 |
| 4,563,107 | A * | 1/1986 | Peterson | E01D 4/00 | 405/157 |
| 4,695,188 | A * | 9/1987 | Pulkkinen | E21D 11/383 | 405/150.2 |
| 4,915,545 | A * | 4/1990 | Ferrari | B65D 90/024 | 52/249 |
| 4,940,360 | A * | 7/1990 | Weholt | E21D 11/14 | 405/150.1 |
| 5,002,438 | A * | 3/1991 | Strong | E04F 21/14 | 405/133 |
| 5,439,319 | A * | 8/1995 | Flanagan | E21D 11/385 | 405/152 |
| 5,833,394 | A * | 11/1998 | McCavour | E01F 5/005 | 405/126 |
| 6,193,439 | B1 * | 2/2001 | Wolfseher | E21D 11/105 | 405/150.2 |
| 6,761,504 | B1 * | 7/2004 | Brandenberger | E21F 16/02 | 405/150.2 |
| 8,220,220 | B2 * | 7/2012 | Kim | E04G 23/0233 | 52/80.1 |
| 10,774,640 | B2 * | 9/2020 | Simon | E21D 11/08 | |
| 2003/0116210 | A1 * | 6/2003 | Ishikawa | E21D 11/107 | 138/175 |
| 2009/0214297 | A1 * | 8/2009 | Wilson | E04B 1/32 | 405/124 |
| 2020/0263543 | A1 * | 8/2020 | Mulvoy | E21D 11/107 | |
| 2021/0017861 | A1 * | 1/2021 | Liu | G01N 21/954 | |
| 2021/0032990 | A1 * | 2/2021 | Pellissier | E01F 5/005 | |

* cited by examiner

COMPOSITE SUPPORT SYSTEM BASED ON STEEL-CONCRETE SUPPORT AND SHOTCRETE ARCH AND CONSTRUCTION PROCESS THEREOF

CROSS REFERENCE TO THE RELATED APPLICATIONS

This application is based upon and claims priority to Chinese Patent Application No. 202210131536.1, filed on Feb. 14, 2022, the entire contents of which are incorporated herein by reference.

TECHNICAL FIELD

The present disclosure belongs to the technical field of underground engineering support, and in particular, relates to a composite support system based on a steel-concrete support and a shotcrete arch and a construction process thereof.

BACKGROUND

With the gradual increase of energy demand and mining intensity in China, deep roadway support is faced with problems such as large surrounding rock deformation, deep high ground pressure, and large roadway floor heave. At present, deep roadway support mainly includes concrete series support, U-shaped scaffold support, active-passive coupling series support, etc., which ensure roadway stability by controlling the surrounding rock deformation. In engineering practice, these support forms are implemented in a complex deep mechanical environment featuring high ground stress, high geothermal, high seepage pressure, and strong mining disturbance. The anisotropic virgin stress will cause rock ductility damage, leading to serious deformation and damage to the support structure and roadway.

At present, anchor-mesh-shotcrete support is widely used in deep roadway support. Anchor bolts are driven first, then a reinforcement mesh is provided, followed by shotcrete, and finally, a rigid support is erected or a concrete arch is formed based on anchor-mesh-shotcrete. This active-passive coupling support method has a low bearing capacity, and the shotcrete is a brittle support material, which easily cracks and spalls after being compressed. In addition, the support is not waterproof, so it is easy to cause the surrounding rock to leak after the concrete cracks, resulting in the corrosion of the roadway support system or the destruction of the roadway floor due to water immersion and softening, thus reducing the overall stability of the roadway.

SUMMARY

To solve the technical problems existing in the prior art, the present disclosure provides a composite support system based on steel-concrete support and a shotcrete arch and the construction process thereof. The system adapts to various factors such as mining disturbance and high ground pressure in a deep roadway and adapts to irregular displacement and deformation of the roadway to a certain extent to avoid structural layer damage. In addition, the system can slow down and absorb the energy generated by the mining disturbance.

An embodiment of the present disclosure provides a composite support system based on steel-concrete support and a shotcrete arch. The composite support system includes an anchor mesh layer provided on an inner wall of a roadway. A flexible compressible layer is provided on the outer side of the anchor mesh layer. A support frame is erected on the outer side of the flexible compressible layer. Reinforcement meshes are respectively arranged on the inner side and the outer side of the support frame. The support frame and the reinforcement meshes form a framework to construct an arch spray layer. The reinforcement mesh and the support frames are embedded into an arch structure to form a rigid layer. The flexible compressible layer is provided between the rigid layer and the anchor mesh layer. When the anchor mesh layer is compressed, the flexible compressible layer is first compressed for a yielding purpose and then contacts with the rigid layer to form a coupling support.

Further, the reinforcement meshes each are provided with burrs to increase a shotcrete bonding strength to form the high-strength arch structure.

Further, a waterproof coating is sprayed on the outer side of the flexible compressible layer.

Further, the support frame is formed by connecting multiple circular steel pipe support frames. Each of the circular steel pipe support frames is formed by connecting a top arc section, a bottom arc section, and a side arc section. Every two adjacent arc sections are connected by an inner-buckle type joint sleeve and are fastened by a reinforcement.

Further, a gap is provided between the flexible compressible layer and the support frame and is filled with a wood back plate in a pattern. Further, the flexible compressible layer has a thickness to extend beyond the end of the anchor bolt.

Further, the rigid layer is a semicircle arched structure provided in an upper arched section of the roadway. In a lower arched section of the roadway, the support member is provided between the outer side of the flexible compressible layer and the support frame. A filling layer is provided on the outer side of the support frame to form a working surface.

Further, the anchor mesh layer includes multiple anchor bolts embedded in the roadway, and the ends of the anchor bolts penetrate through the reinforcement mesh and are pressed on the reinforcement mesh through a tray.

An embodiment of the present disclosure further provides a construction process of the composite support system based on steel-concrete support and a shotcrete arch described in any one of the above paragraphs, including the following steps:

- excavating and forming the roadway, forming the supporting anchor mesh layer, and spraying a plastic material on the outer side of the anchor mesh layer to form the flexible compressible layer;
- erecting the support frame, arranging the reinforcement meshes respectively on the inner side and the outer side of the support frame, and filling a space between the outer side of the support frame and the flexible compressible layer with a back plate; and
- spraying high-strength concrete on the inner side and the outer side of the support frame to form the arch structure and reserving the deformation space between the concrete arch structure and the flexible compressible layer through the support of the back plate.

Further, the construction process includes: Before forming the arch structure: providing a first burred reinforcement mesh on the inner side of the support frame, and spraying the high-strength concrete for the first time; and providing, after a preset time, a second burred reinforcement mesh, and spraying the high-strength concrete for a second time. During the whole spraying process, the spraying direction is always perpendicular to the surrounding rock. The high-strength concrete is first sprayed on the surrounding rock on two sides of the roadway and then sprayed on the surrounding rock on a top of the roadway and an inverted bottom arch.

The present disclosure has the following advantages:

In the composite support system provided by the present disclosure, when the roadway is subjected to high mining disturbance, the anchor mesh layer and flexible compressible layer provided on the roadway wall provide active support. The active support adapts to irregular displacement and deformation of the roadway to a certain extent to avoid structural layer damage. In addition, it can slow down and absorb the energy generated by the mining disturbance. When the flexible compressible layer is compressed and deformed, the pressure is yielded and relieved in the space between the flexible compressible layer and the arch structure. After deformation, the flexible compressible layer can contact and support the rigid layer embedded with the support frame and reinforcement. The inner and outer sides of the support frame in the arch are provided with reinforcement meshes to enable the rigid layer to bear strong support pressure. In this way, the anchor mesh layer, the flexible compressible layer, and the rigid layer combine rigid and flexible supports, combine active and passive supports, and yield before resistance, thus effectively preventing the displacement and deformation of the deep roadway.

BRIEF DESCRIPTION OF THE DRAWINGS

The drawings constituting a part of the present disclosure provide a further understanding of the present disclosure. The indicative embodiment and its description of the present invention are used to explain the present invention and do not constitute an improper limitation of the present invention.

Figure 1:
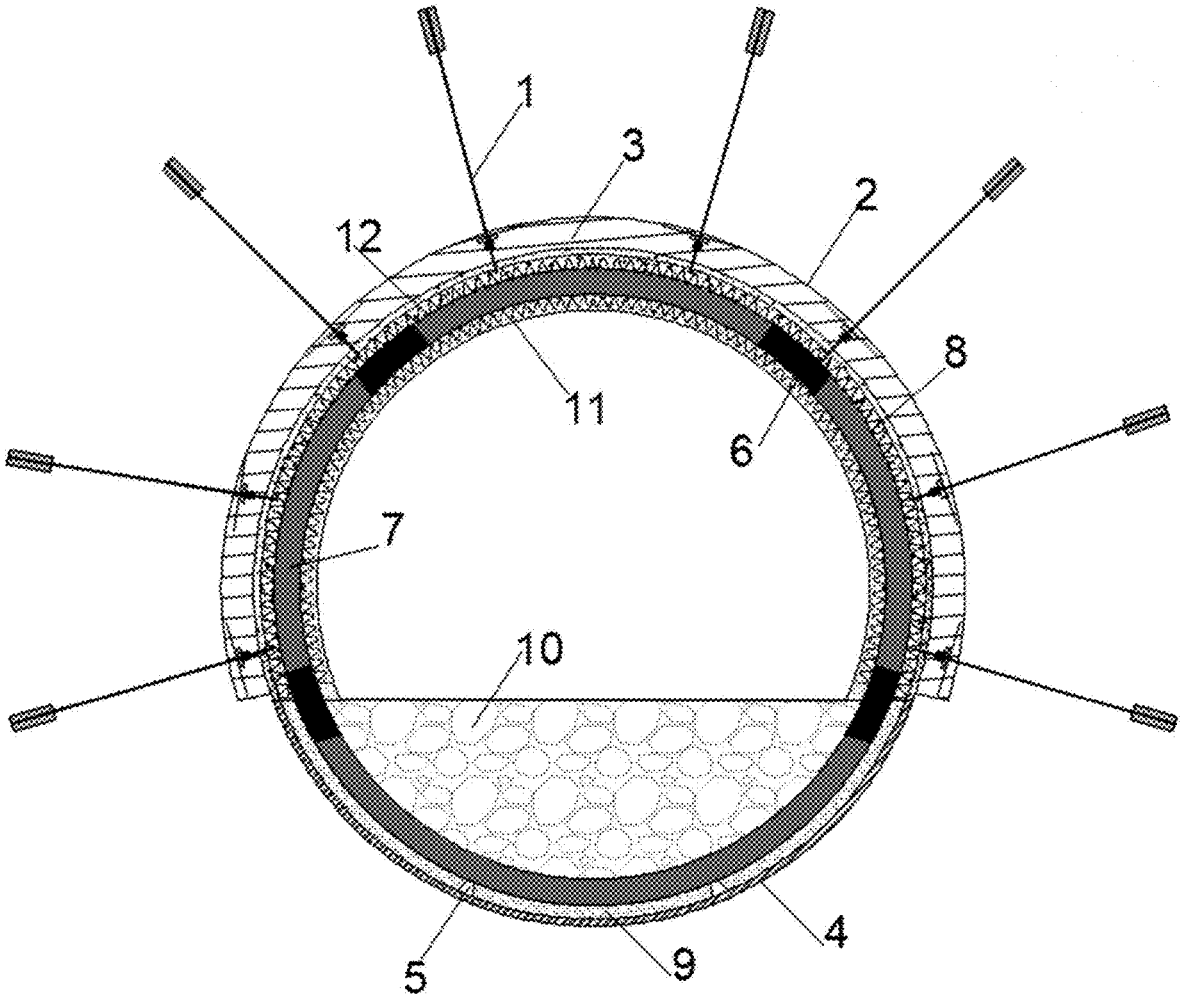
FIG. 1 is an overall structural diagram of a composite support system for a roadway according to an embodiment of the present disclosure.

Reference Numerals: 1. anchor bolt; 2. excavation section; 3. flexible compressible layer; 4. waterproof layer; 5. I-beam; 6. joint sleeve; 7. support frame; 8. arc pressure relief space; 9. plastic spraying material; 10. gangue layer; 11. arch structure; 12. burred reinforcement mesh; 13. back plate; 14. prefabricated arc plate layer; and 15. high-strength concrete layer.

DETAILED DESCRIPTION OF THE EMBODIMENTS

As shown in FIG. 1, an embodiment of the present disclosure provides a roadway composite support system based on steel-concrete (concrete-filled steel tube) support and a shotcrete arch. The composite support system mainly includes multiple anchor bolts 1 arranged in a circumferential direction of a roadway, which cooperate with a reinforcement mesh to form an anchor mesh layer as a temporary support.

Further, plastic material is sprayed on the outer side of the anchor mesh layer through a special device to form flexible compressible layer 3, which is configured to flexibly resist a high mining disturbance on a wall surface. Rigid support frame 7 is erected on the outer side of the flexible compressible layer 3 to assist in resisting the high mining disturbance.

A deformation space is reserved between the support frame 7 and the flexible compressible layer 3 to form arc pressure relief space 8. The arc pressure relief space 8 has a certain thickness. When the flexible compressible layer 3 is under pressure, arc pressure relief space 8 performs certain yielding, pressure relief, and deformation.

Further, high-strength concrete is sprayed on the inner side and the outer side of the support frame 7 to form circular arch structure 11. Burred reinforcement meshes 12 are provided on the inner side and the outer side of the support frame. The circular arch structure 11 wraps the support frame 7 and the burred reinforcement meshes 12 to form a rigid layer.

In this way, in the composite support system provided by the embodiment of the present disclosure, when the roadway is subjected to high mining disturbance, the anchor mesh layer and flexible compressible layer provided on the roadway wall provide active support. The active support adapts to irregular displacement and deformation of the roadway to a certain extent to avoid structural layer damage. In addition, it can slow down and absorb the energy generated by the mining disturbance. When the flexible compressible layer is compressed and deformed, the pressure is yielded and relieved in the space between the flexible compressible layer and the rigid layer. After deformation, the flexible compressible layer can contact and support the rigid layer embedded with the support frame and reinforcement. The inner and outer sides of the support frame in the arch are provided with reinforcement meshes to enable the rigid layer to bear strong support pressure. In this way, the anchor mesh layer, the flexible compressible layer, and the rigid layer combine rigid and flexible supports, combine active and passive supports, and yield before resistance, thus effectively preventing the displacement and deformation of the deep roadway.

Specifically, in this embodiment, the anchor mesh layer is a temporary support for maintaining roadway safety and working space before erecting the permanent support on excavation section 2 of the deep roadway to protect the safety of excavation workers. It is also a part of the permanent support to prepare for the spraying of the roadway.

To enhance the stability of the surrounding rock and compatibility with the flexible compressible layer 3, the anchor bolts 1 are generally φ 20×2,400 mm anchor bolts and are pressed on the reinforcement mesh through a tray.

Figure 2:
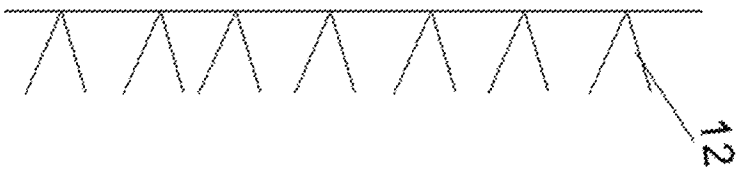
FIG. 2 is a side view of a burred reinforcement mesh according to an embodiment of the present disclosure.

As shown in FIG. 1 and FIG. 2, the flexible compressible layer 3 in this embodiment is preferably made of a plastic spraying material, which can achieve high construction efficiency and standardized quality. Waterproof coating 4 may be sprayed on the outer side of the flexible compressible layer 3 to form a yielding and waterproof layer to adapt to a certain degree of deformation of the surrounding rock.

It should be noted that in this embodiment, the thickness of the flexible compressible layer 3 is determined according to the length of the end of the anchor bolt 1. Generally, the flexible compressible layer 3 has the coating thickness of 20-40 mm away from the end of the anchor bolt 1 to avoid damage to pressure relief, energy absorption, and closed waterproof structure. A coupling control mechanism between the plastic material layer and the anchor mesh layer is determined before spraying to combine the plastic material layer and the anchor mesh layer well.

Preferably, in this embodiment, the flexible compressible layer 3 is formed by spraying a plastic spraying material. This is a green, micro-expansive, two-component, multipurpose composite modified spraying material, which can provide the composite support system with the advantages of flexible pressure relief and energy absorption. When the pressure on the roadway is too large, the flexible compressible layer 3 is compressed, deformed, and thinned due to the stress of the surrounding rock. In addition, the flexible compressible layer 3 is plastic, can avoid damage to the structural layer, and can relieve the pressure in time. The pressure is transferred to the arch and the support frame to give full play to the working performance of the support frame, that is, to yield to the pressure before resisting.

Further, in this embodiment, the support frame 7 is mainly formed by connecting multiple circular steel pipe support frames. Every two adjacent circular steel pipe support frames are connected by a concrete-filled steel pipe rod or other mechanisms.

Referring to FIG. 1, in this embodiment, each circular steel pipe support frame of the support frame 7 is formed by connecting a top arc section, a side arc section, and a bottom arc section. Every two adjacent arc sections are connected by inner-buckle type joint sleeve 6 and are fastened by 23 reinforcements with a diameter of not less than 15 mm to prevent the sleeve from slipping and becoming damaged.

The support frame can be a commonly used round or oval support, generally with an outer diameter of 150-265 mm and a wall thickness of 6-16 mm. The joint sleeve can have an outer diameter of 160-285 mm. Of course, in this embodiment, the support frame can also be a concrete-filled glass fiber reinforced polymer (GFRP) pipe support frame or other high-strength support.

Figure 3:
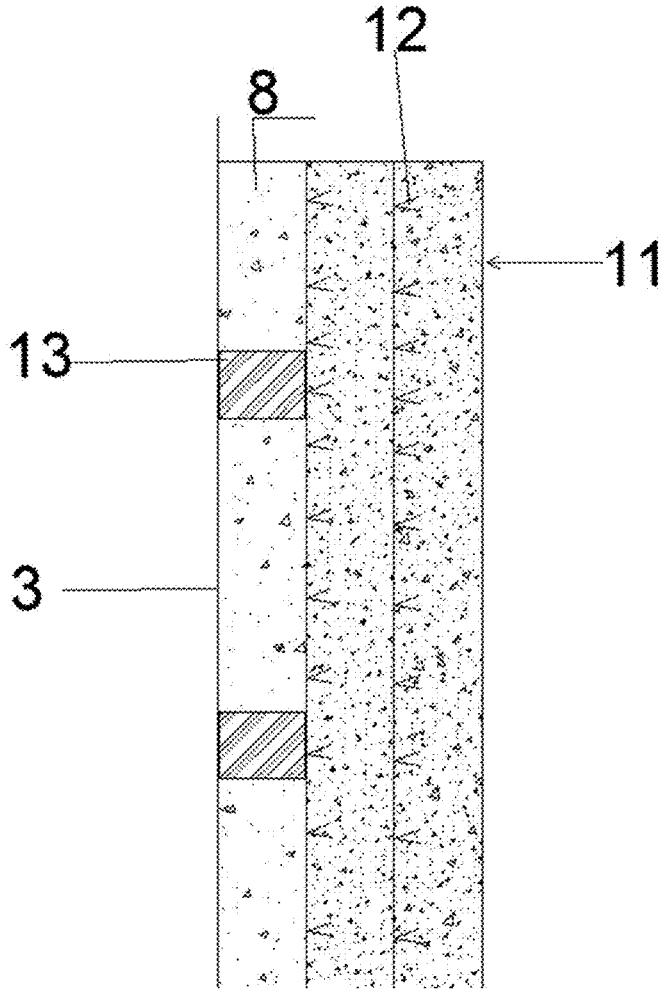
FIG. 3 is a partial section view of an arch according to an embodiment of the present disclosure.

Further, as shown in FIG. 2 and FIG. 3, in this embodiment, the burred reinforcement meshes 12 are respectively arranged on an inner side and an outer side of the support frame. Each of the burred reinforcement meshes 12 is mainly a mesh structure formed by connecting multiple transverse reinforcements and multiple longitudinal reinforcements. Burrs are arranged on the surfaces of the reinforcements, and then the high-strength concrete is sprayed in layers and sections to form the arch structure 11 with a certain thickness to connect the burred reinforcement meshes 12 and the support frame together.

Preferably, the burred reinforcement meshes 12 in this embodiment are generally 100×100 mm burred reinforcement meshes. During preparation, each of the reinforcements has a diameter of not less than 8 mm. 1-3 burrs are provided for each 100 mm of the reinforcement, and the burrs are respectively arranged on two sides of the concrete-filled steel pipe support frame to increase an adhesion area of the high-strength concrete. When the mining disturbance is too large, the distribution of the anisotropic high pressure and high shear stress can be optimized by the burred reinforcement meshes 12 and the arch, such that the roadway will be uniformly stressed and will be prevented from local damage. The design makes full use of the advantages of the composite support system.

Of course, for a roadway with broken surrounding rock, reinforcement frameworks can be prepared on the inner side and the outer side of the support frame 7, and high-strength concrete is poured to form the arch structure 11.

Preferably, the high-strength concrete has a 24-hour uniaxial compressive strength of not less than 8 MPa, and water used for shotcreting is clean water without impurities, rather than sewage or acidic water with a pH of less than 4. The concrete has a strength grade of C30 to C40, generally C40. The arch is generally 200 mm thick and 800 mm wide and covers the entire roadway.

Further, in this embodiment, an arc pressure relief space is provided between the arch structure 11 and the flexible compressible layer 3. Referring to FIG. 1 and FIG. 3, in this embodiment, when the support frame 7 is erected, a certain space is reserved between the support frame 7 and the flexible compressible layer 3. Back plate 13 is placed in the space. An end surface of the back plate 13 is in contact with the arch structure 11. The arc pressure relief space 8 is formed by a thickness space of the back plate 13. The arc pressure relief space 8 may be hollow or filled with a flexible material to form the pressure relief space that is not fully dense. When the flexible compressible layer 3 is compressed, the arc pressure relief space 8 undergoes a certain deformation. Therefore, the arc pressure relief space 8 can assist the anchor mesh layer and the flexible compressible layer 3 to make flexible yielding to form a pressure relief energy adsorption-pressure relief system and give full play to the synergy between the active support layers.

It should be noted that on the premise of meeting the safety and technical requirements, the shape and size of the roadway section are determined according to the nature of the surrounding rock and the size and direction of the ground pressure acting on the roadway, and then the shape and size of the support frame are determined. According to the actual construction on site, the section shape of the arch needs to adapt to the roadway section and support form. The main parameters to be determined further include the thickness of the spraying layer, the material ratio of the high-strength concrete, the type, and quantity of additives, the thickness of the arch, the spacing of the support frame, etc.

Figure 4:
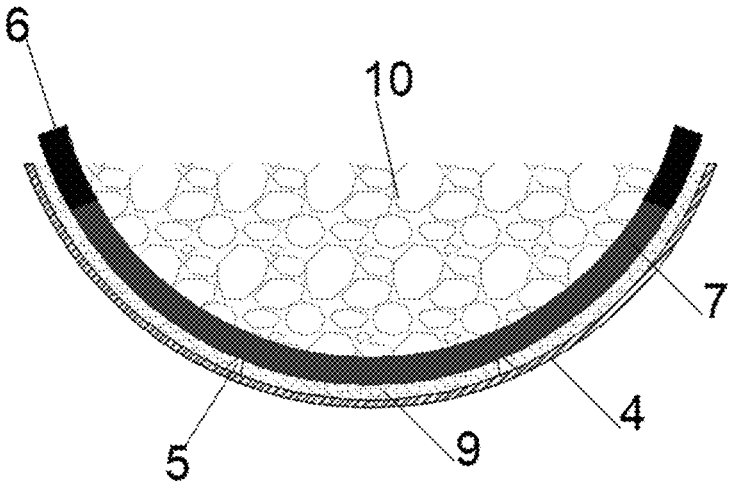
FIG. 4 is a structural diagram of a first support for a roadway bottom according to an embodiment of the present disclosure.
Figure 5:
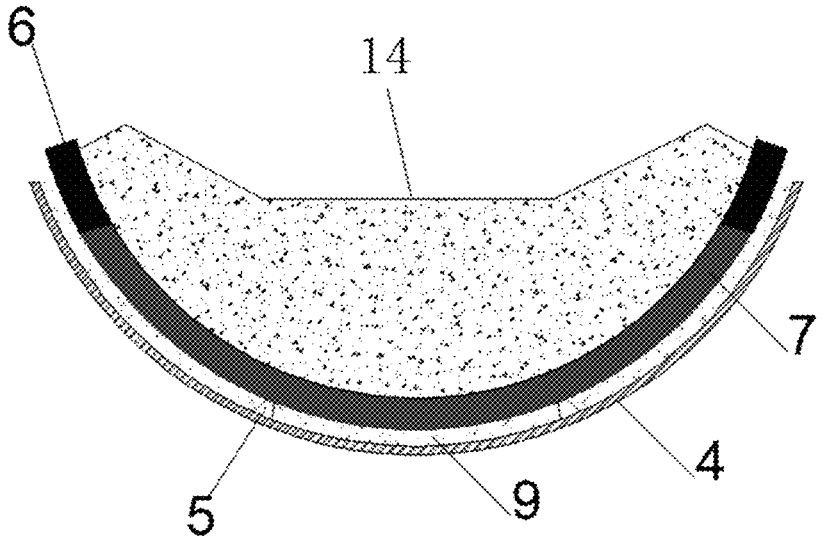
FIG. 5 is a structural diagram of a second support for the roadway bottom according to an embodiment of the present disclosure.
Figure 6:
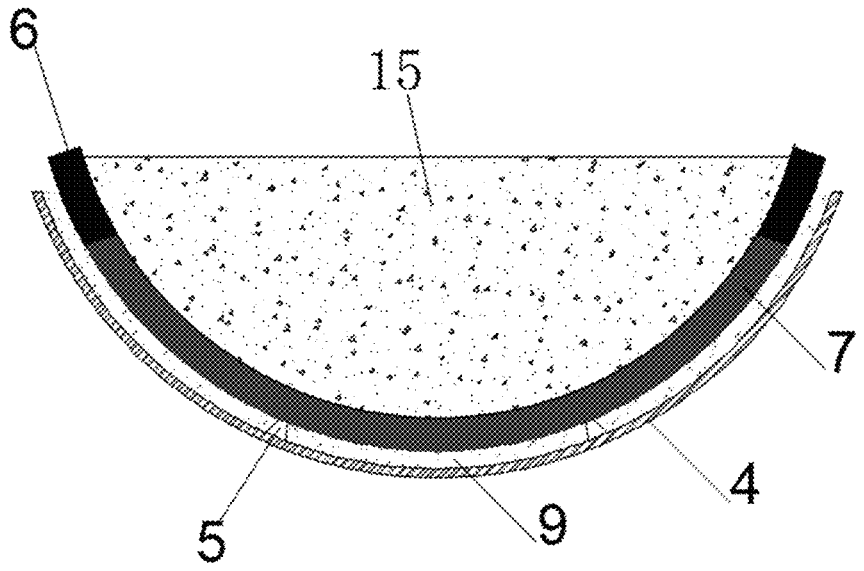
FIG. 6 is a structural diagram of a third support for the roadway bottom according to an embodiment of the present disclosure.

Further, the composite support system provided by the embodiment of the present disclosure proposes a roadway bottom treatment method. In the deep roadway, the deformation of the surrounding rock caused by floor heave has become the main problem hindering the efficient production of the mine. As shown in FIG. 4 to FIG. 6, a bottom arch is formed by spraying a plastic material at a bottom of the roadway. After the bottom arch is solidified, 2-3 steel beams are arranged on an upper part of the bottom arch, and the support frame 7 is erected on the steel beams. After the support frame 7 is erected, a filling layer is provided to form a working surface.

As shown in FIG. 4, after the support frame 7 is erected, the concrete is sprayed with a certain thickness, and gangue layer 10 is backfilled and leveled to form the bottom arch.

As another embodiment, referring to FIG. 5, after the excavation of a roadway bottom, the construction is carried out in the following sequence. The airtight waterproof layer 4 is formed, 2-3 I-beams 5 are arranged, the support frame 7 is erected, and high-strength prefabricated arc plate layer 14 is provided on the outer side of the support frame.

Alternatively, as shown in FIG. 6, after the excavation of the bottom arch, the construction is carried out in the following sequence. 2-3 I-beams 5 are arranged, a concrete-filled steel pipe support frame is erected, and high-strength concrete layer 15 is sprayed to wrap the concrete-filled steel pipe support frame, such that two ends of the bottom arch are pressed under the wall and connected with the wall as a whole, and finally, secondary spraying is performed to form the roadway.

A construction process of the composite support system based on steel-concrete support and a shotcrete arch provided by the above embodiment of the present disclosure includes the following steps.

Step 1. The roadway is excavated and formed, and a supporting anchor mesh layer is formed to ensure the stability and safety of the construction space in a short time.

Step 2. The plastic material is sprayed to form the flexible compressible layer 3 through the spraying device, and the waterproof layer 4 is provided on the outer side of the flexible compressible layer 3 to form the yielding and waterproof layer 4.

Step 3. The assembly of empty steel pipe support frames is completed through an assembly machine, and the back plate 13 is filled. Before assembly, 2-3 I-beams 5 are placed in an inverted bottom arch section, and anchor the first support frame and every 10 support frames thereafter.

Step 4. 10-15 empty steel pipe support frames are erected, and core concrete is poured once. To fill the steel pipe fully with concrete, the construction is carried out in the sequence of the bottom arc section, the side arc section, and the top arc section.

Step 5. First burred reinforcement mesh 12 is provided on the inner side of the support frame 7, and the high-strength concrete is sprayed with a thickness of about 100 mm. After a certain time (5-10 min), a second burred reinforcement mesh 12 is provided, and the high-strength concrete is sprayed (100 mm) to form the arch structure.

During the whole spraying process, the spraying direction is always perpendicular to the surrounding rock, and the spraying is carried out in sections, parts, and zones, from bottom to top, targeting a concave part first and then a convex part. The concrete is first sprayed on the surrounding rock on two sides of the roadway and then sprayed on the surrounding rock on the top of the roadway and the inverted bottom arch. The design can ensure the construction quality of the arch and form a stable passive support system with the concrete-filled steel pipe support frame.

The above steps are repeated to complete all the construction of the support frame 7, and finally, a stable composite support system that combines active and passive supports and carries out yielding before resisting is formed.

It should be noted that the above embodiments are only intended to explain, rather than to limit the technical solutions of the present disclosure. Although the present disclosure is described in detail with reference to the preferred embodiments, those skilled in the art should understand that modifications or equivalent substitutions may be made to the technical solutions of the present disclosure without departing from the spirit and scope of the technical solutions of the present disclosure, and such modifications or equivalent substitutions should be included within the scope of the claims of the present disclosure.

The above described are the specific implementations of the present disclosure, but they are not intended to limit the protection scope of the present disclosure. Those skilled in the art should understand that any modifications or variations made by those skilled in the art without creative efforts still fall within the protection scope of the present disclosure based on the technical solutions of the present disclosure.

What is claimed is:

1. A composite support system based on a steel-concrete support and a shotcrete arch structure, comprising an anchor mesh layer provided on an inner wall of a roadway, wherein a flexible compressible layer is provided on an outer side of the anchor mesh layer;

a waterproof layer is provided on an outer side of the flexible compressible layer to form a yielding and waterproof layer to adapt to deformation of a surrounding rock;

a support frame is provided on the outer side of the flexible compressible layer;

reinforcement meshes are respectively arranged on an inner side and an outer side of the support frame;

the support frame and the reinforcement meshes form a framework to construct the shotcrete arch structure;

the reinforcement meshes and the support frame are embedded into the shotcrete arch structure to form a rigid layer;

a deformation space is reserved between the rigid layer and the anchor mesh layer; and when the anchor mesh layer and the flexible compressible layer are compressed, the anchor mesh layer and the flexible compressible layer are deformed toward the reserved deformation space for a yielding purpose and then contact with the rigid layer to form a coupling support;

the reserved deformation space comprises a support member provided between the flexible compressible layer and the rigid layer; and two opposite sides of the support member are respectively butted with the flexible compressible layer and the rigid layer; and when a pressure on the roadway is too large, the flexible compressible layer is compressed, deformed, and thinned due to a stress of the surrounding rock; the flexible compressible layer is plastic to avoid a structural layer damage, and to relieve the pressure; and the pressure is transferred to the rigid layer of the support frame by yielding to the pressure before resisting.

2. The composite support system based on the steel-concrete support and the shotcrete arch structure according to claim 1, wherein each of the reinforcement meshes is provided with burrs.

3. The composite support system based on the steel-concrete support and the shotcrete arch structure according to claim 2, wherein a waterproof coating is sprayed on the outer side of the flexible compressible layer.

4. The composite support system based on the steel-concrete support and the shotcrete arch structure according to claim 1, wherein the support frame is formed by connecting multiple circular steel pipe support frames; each of the circular steel pipe support frames is formed by connecting a top arc section, a bottom arc section, and a side arc section; and every two adjacent arc sections are connected by an inner-buckle type joint sleeve, and are fastened by a reinforcement.

5. The composite support system based on the steel-concrete support and the shotcrete arch structure according to claim 1, wherein the flexible compressible layer has a thickness to extend beyond an end of an anchor bolt.

6. The composite support system based on the steel-concrete support and the shotcrete arch structure according to claim 1, wherein the rigid layer is a semicircle arched structure provided in an upper arched section of the roadway; in a lower arched section of the roadway, the support member is provided between the outer side of the flexible compressible layer and the support frame; and a filling layer is provided on the outer side of the support frame to form a working surface.

7. A construction process of the composite support system based on the steel-concrete support and the shotcrete arch structure according to claim 1, comprising the following steps:

excavating and forming the roadway, forming the supporting anchor mesh layer, and spraying a plastic material on the outer side of the anchor mesh layer to form the flexible compressible layer;

erecting the support frame, arranging the reinforcement meshes respectively on the inner side and the outer side of the support frame, and filling a space between the outer side of the support frame and the flexible compressible layer with a back plate; and spraying a high-strength concrete on the inner side and the outer side of the support frame to form the shotcrete arch structure, and reserving the deformation space between the shotcrete arch structure and the flexible compressible layer through a support of the back plate.

8. The construction process according to claim 7, further comprising: before forming the shotcrete arch structure: providing a first burred reinforcement mesh on the inner side of the support frame, and spraying the high-strength concrete for a first time; and providing, after a preset time, a second burred reinforcement mesh, and spraying the high-strength concrete for a second time, wherein during a whole spraying process, a spraying direction is always perpendicular to the surrounding rock; and the high-strength concrete is first sprayed on the surrounding rock on two sides of the roadway and then sprayed on the surrounding rock on a top of the roadway and an inverted bottom arch.

9. The construction process according to claim 7, wherein in the composite support system, each of the reinforcement meshes is provided with burrs.

10. The construction process according to claim 9, wherein in the composite support system, a waterproof coating is sprayed on the outer side of the flexible compressible layer.

11. The construction process according to claim 7, wherein in the composite support system, the support frame is formed by connecting multiple circular steel pipe support frames; each of the circular steel pipe support frames is formed by connecting a top arc section, a bottom arc section, and a side arc section; and every two adjacent arc sections are connected by an inner-buckle type joint sleeve, and are fastened by a reinforcement.

12. The construction process according to claim 7, wherein in the composite support system, the flexible compressible layer has a thickness to extend beyond an end of an anchor bolt.

13. The construction process according to claim 7, wherein in the composite support system, the rigid layer is a semicircle arched structure provided in an upper arched section of the roadway; in a lower arched section of the roadway, the support member is provided between the outer side of the flexible compressible layer and the support frame; and a filling layer is provided on the outer side of the support frame to form a working surface.

* * * * *